US008205273B2

(12) United States Patent
Kataoka

(10) Patent No.: US 8,205,273 B2
(45) Date of Patent: Jun. 26, 2012

(54) CHEST PROTECTOR

(75) Inventor: Tetsurou Kataoka, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 343 days.

(21) Appl. No.: 12/543,568

(22) Filed: Aug. 19, 2009

(65) Prior Publication Data

US 2010/0050327 A1 Mar. 4, 2010

(30) Foreign Application Priority Data

Aug. 27, 2008 (JP) ..... 2008-217532

(51) Int. Cl.
*A41D 27/12* (2006.01)
*A41D 13/05* (2006.01)
*A41D 13/00* (2006.01)

(52) U.S. Cl. ..... 2/456; 2/455; 2/459; 2/465; 2/467; 2/274

(58) Field of Classification Search ..... 2/455, 456, 2/2.5, 459–465, 467, 265, 274
See application file for complete search history.

(56) References Cited

U.S. PATENT DOCUMENTS 2,020,702 A * 11/1935 Russell ..... 2/2.5
2,076,076 A * 4/1937 Dunlap ..... 428/181
2,163,463 A * 6/1939 Kennedy ..... 2/462
2,477,989 A * 8/1949 La Maida ..... 2/2.5
2,640,987 A * 6/1953 Ehlers ..... 2/2.5
2,743,446 A * 5/1956 Persico et al. ..... 2/2.5
3,130,414 A * 4/1964 Bailey et al. ..... 2/2.5
3,514,784 A * 6/1970 McDavid ..... 2/468
3,604,685 A * 9/1971 Pokryfki ..... 256/25
3,728,757 A * 4/1973 Lloyd ..... 16/303
3,777,309 A * 12/1973 Yeager ..... 2/2.5
3,803,639 A * 4/1974 Cohen ..... 2/2.5
3,878,561 A * 4/1975 Winiecki ..... 2/461
4,028,743 A * 6/1977 Christensen ..... 2/424
4,184,212 A * 1/1980 Bowman ..... 2/5
4,198,707 A * 4/1980 Haupt et al. ..... 2/2.5
4,232,613 A * 11/1980 Kempf ..... 109/40
4,303,176 A * 12/1981 Swartzbaugh ..... 220/835
4,438,958 A * 3/1984 De Cenzo ..... 285/234
4,465,330 A * 8/1984 De Cenzo ..... 439/92
4,483,020 A * 11/1984 Dunn ..... 2/2.5
4,680,812 A * 7/1987 Weigl ..... 2/467
4,783,853 A * 11/1988 Zuber ..... 2/456
4,996,720 A * 3/1991 Fair ..... 2/462
5,044,011 A * 9/1991 Henderson ..... 2/2.5
5,107,542 A * 4/1992 Zide et al. ..... 2/462
5,117,987 A * 6/1992 Lombardo ..... 211/105.1
5,140,995 A * 8/1992 Uhl ..... 128/846

(Continued)

FOREIGN PATENT DOCUMENTS

CN 88210850 U 11/1988

(Continued)

*Primary Examiner* — Bobby Muromoto, Jr.
(74) *Attorney, Agent, or Firm* — Birch, Stewart, Kolasch & Birch, LLP

(57) ABSTRACT

To enable a front portion of a chest protector to be easily undone to allow cooling down while maintaining the protection performance for the chest protector fitted to a garment. A chest protector detachably fitted to an interior surface of a body garment includes left and right protective shell members, with the left and right protective shell members engaging in a separable manner.

16 Claims, 11 Drawing Sheets

U.S. PATENT DOCUMENTS

| | | | | |
|---|---|---|---|---|
| 5,293,807 | A * | 3/1994 | Hajdu | 89/36.07 |
| 5,497,512 | A * | 3/1996 | Wright | 2/102 |
| 5,771,489 | A * | 6/1998 | Snedeker | 2/2.5 |
| 5,915,528 | A * | 6/1999 | Shmuelov | 2/2.5 |
| 5,978,961 | A * | 11/1999 | Barker | 2/2.5 |
| 5,996,785 | A * | 12/1999 | Palmer et al. | 206/308.1 |
| 6,026,510 | A * | 2/2000 | Kocher | 2/2.5 |
| 6,056,624 | A * | 5/2000 | Fildan | 450/1 |
| 6,070,273 | A * | 6/2000 | Sgro | 2/455 |
| 6,098,196 | A * | 8/2000 | Logan | 2/2.5 |
| 6,126,119 | A * | 10/2000 | Giangrasso | 248/58 |
| 6,295,654 | B1 * | 10/2001 | Farrell | 2/456 |
| 6,397,402 | B1 * | 6/2002 | Holland et al. | 2/467 |
| 6,554,147 | B1 * | 4/2003 | Maida et al. | 220/4.23 |
| 6,691,601 | B2 * | 2/2004 | Cohen et al. | 89/36.05 |
| 6,892,392 | B2 * | 5/2005 | Crye et al. | 2/2.5 |
| 6,920,670 | B2 * | 7/2005 | Hao | 16/340 |
| 7,329,230 | B2 * | 2/2008 | Mazzarolo | 602/19 |
| 7,464,414 | B2 * | 12/2008 | McDuff | 2/455 |
| 7,653,422 | B2 * | 1/2010 | Roberts | 455/575.4 |
| 7,712,157 | B2 * | 5/2010 | Laundre | 4/236 |
| 2001/0029621 | A1 * | 10/2001 | Howland et al. | 2/2.5 |
| 2003/0005548 | A1 * | 1/2003 | Kim et al. | 16/296 |
| 2003/0110933 | A1 * | 6/2003 | Baker | 89/36.05 |
| 2005/0010987 | A1 * | 1/2005 | Crye et al. | 2/2.5 |
| 2005/0025563 | A1 * | 2/2005 | Sato et al. | 402/73 |
| 2005/0223477 | A1 * | 10/2005 | Batstone et al. | 2/463 |
| 2006/0010590 | A1 * | 1/2006 | Huschke et al. | 2/459 |
| 2009/0113589 | A1 * | 5/2009 | Haakana | 2/2.5 |
| 2010/0084586 | A1 * | 4/2010 | Teodorescu | 250/516.1 |
| 2010/0122404 | A1 * | 5/2010 | Bowlus et al. | 2/467 |

FOREIGN PATENT DOCUMENTS

| | | | |
|---|---|---|---|
| CN | 2292416 | Y | 9/1998 |
| JP | 2002-350096 | A | 12/2002 |

* cited by examiner

CHEST PROTECTOR

CROSS-REFERENCE TO RELATED APPLICATIONS

The present application claims priority under 35 USC 119 to Japanese Patent Application No. 2008-217532 filed on Aug. 27, 2008 the entire contents of which are hereby incorporated by reference.

BACKGROUND OF THE INVENTION

1. Field of the Invention

The present invention relates to a chest protector fitted to a body garment.

2. Description of Background Art

Conventional supporters are known that are constructed by fitting a single piece front shell (chest protector) that covers the chest and upper abdominal region of the wearer to a waistcoat type garment worn on the upper body of the wearer. See, for example, Japanese Patent Publication Laid-open No. 2002-350096.

In the supporter described above, superior protection is achieved because the chest and the upper abdominal region of the wearer are covered by the single piece front shell. There are cases where the wearer will wish to cool off by opening the front portion of the waistcoat type garment while, for example, taking a rest. However, it is not possible to open up the front portion to cool off with the supporter described above because the chest and the upper abdominal region of the wearer are covered by the single piece front shell.

SUMMARY AND OBJECTS OF THE INVENTION

It is therefore the object of the present invention to make it easy to cool off by opening up the front portion of the garment and the chest protector while maintaining protection performance at the chest protector fitted to the garment.

In order to resolve the problems described above, the present invention provides a chest protector detachably fitted to the back surface of a body garment, the chest protector includes left and right members, wherein the left and right members each have mutually engaging portions, with the engaging portions engaging with each other in a separable manner. According to this configuration, it is possible to cover a broad range of the chest with the signal piece chest protector while using the chest protector as a protective member and it is possible to separate the chest protector by just releasing the engagement of the left member and the right member when it is wished to separate the chest protector. As a result, the wearer can cover a broad range of the chest using the chest protector and can ensure a high protection performance. When it is wished to remove the front portion, it is possible to separate the chest protector and to easily cool down by opening up the front portion of the garment and the chest protector.

In the above configuration, it is also possible for the engaging portions of each of the left and right members to each be provided with a stopping portion opposing pressing force from the front. According to this configuration, it is possible to resist pressing force from the front of the chest protector by using stopping portions that are respectively provided on the left member and the right member. This means that it is possible to deal with a pressing force from the front even in cases where the chest protector is given a separable structure and a high protection performance can be attained.

The left and right engaging portions can comprise a plurality of projecting portions with the left and right projecting portions being arranged alternately so as to engage with each other. In this event, the left member and right member engage each other with fellow projecting portions of the plurality of projecting portions alternately lined up. It is therefore possible for stress to be dissipated at the plurality of projecting portions, for the stress exerted on the engaging portions of the left and right members to be made uniform, and to ensure the necessary rigidity strength with respect to pressing force from the front.

The left and right projecting portions can also have lugs extending to the front side of the opposing side and each engaging with a recess at the front side. In this event, the projecting portions of the left and right members, which mutually extend forward on the front side of the opposing projecting portions, provide mutual support for the front of the left and right members with respect to a pressing force from the front of the chest protector and it is therefore possible to deal with the pressing force from the front. On the other hand, the projecting portions are not mutually supported at the front surface of the left member and the right member with respect to the pressing force from the back of the chest protector. It is therefore possible to release the engagement by pressing the chest protector from the back. Thus, a cooling down can easily take place. The lugs formed at the projecting portions engage with a recess formed at the front side of the opposing surface. It is therefore possible to oppose the force separating the chest protector towards the left and right. It is therefore possible to prevent the engagement of the left and right members from being unintentionally released so as to separate the chest protector in the left and right directions.

Either one of the left and right engaging portions, which overlap with each other from front to back, can include an outwardly projecting portion and the other engaging portion can include an inwardly projecting portion. An extending portion extending to the inner side of the inwardly projecting portion is then provided on a base portion of the outwardly projecting portion. In this event, the outwardly projecting portions support the front side of the inwardly projecting portions with respect to pressing force from the front of the chest protector and the inwardly projecting portions support the extending portions of the outwardly projecting portions. The outwardly projecting portions and the inwardly projecting portions therefore mutually support each other. It is therefore possible to deal with the pressing force from the front. On the other hand, the outwardly projecting portions come away from the front side of the inwardly projecting portions and the inwardly projecting portions come away from the extending portions with respect to the pressing force from the back of the chest protector. Thus, the engagement can therefore be released by pressing the chest protector from the back and a cooling off can easily take place.

The chest protector of the present invention is capable of protecting a broad range of the chest of the wearer and high protection performance can be ensured. When it is wished to undo the front portion, it is possible to separate the chest protector and the front portion of the garment and the chest protector can be undone so that a cooling down can easily take place. It is also possible to deal with the pressing force from the front using the stopping portions even in cases where the chest protector can be separated and high protection performance can therefore be obtained. It is therefore possible for stress to be distributed at the plurality of projecting portions, stress is applied in a uniform manner to the engaging portions of the left and right members, and it is possible to ensure the necessary rigidity and strength with respect to pressing force from the front.

Projecting portions extending to the front surface of the opposing side are mutually supported by the front surfaces of the left member and the right member. It is therefore possible to deal with the pressing force from the front. On the other hand, the projecting portions are not mutually supported by the front surface of the left member and the right member with respect to the pressing force from the back. Releasing of the engagement is therefore possible by pressing the chest protector from the back and the cooling down can therefore easily be achieved. The lugs are formed at the projecting portions and engage with a recess on the opposing sides. It is therefore possible to oppose the separation of the chest protector in the left and right directions. It is also possible to prevent the engagement of the left and right members from being released unintentionally and the chest protector being separated to the left and right. In this event, the outwardly projecting portions support the front side of the inwardly projecting portions and the inwardly projecting portions support the extending portions of the outwardly projecting portions. The outwardly projecting portions and the inwardly projecting portions therefore mutually support each other. It is therefore possible to deal with the pressing force from the front. On the other hand, with regards to the pressing force from the back, the outwardly projecting portions come away from the front side of the inwardly projecting portions and the inwardly projecting portions come away from the extending portions. It is therefore possible to release engagement by pressing the chest protector from the back so that the cooling down can easily be achieved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
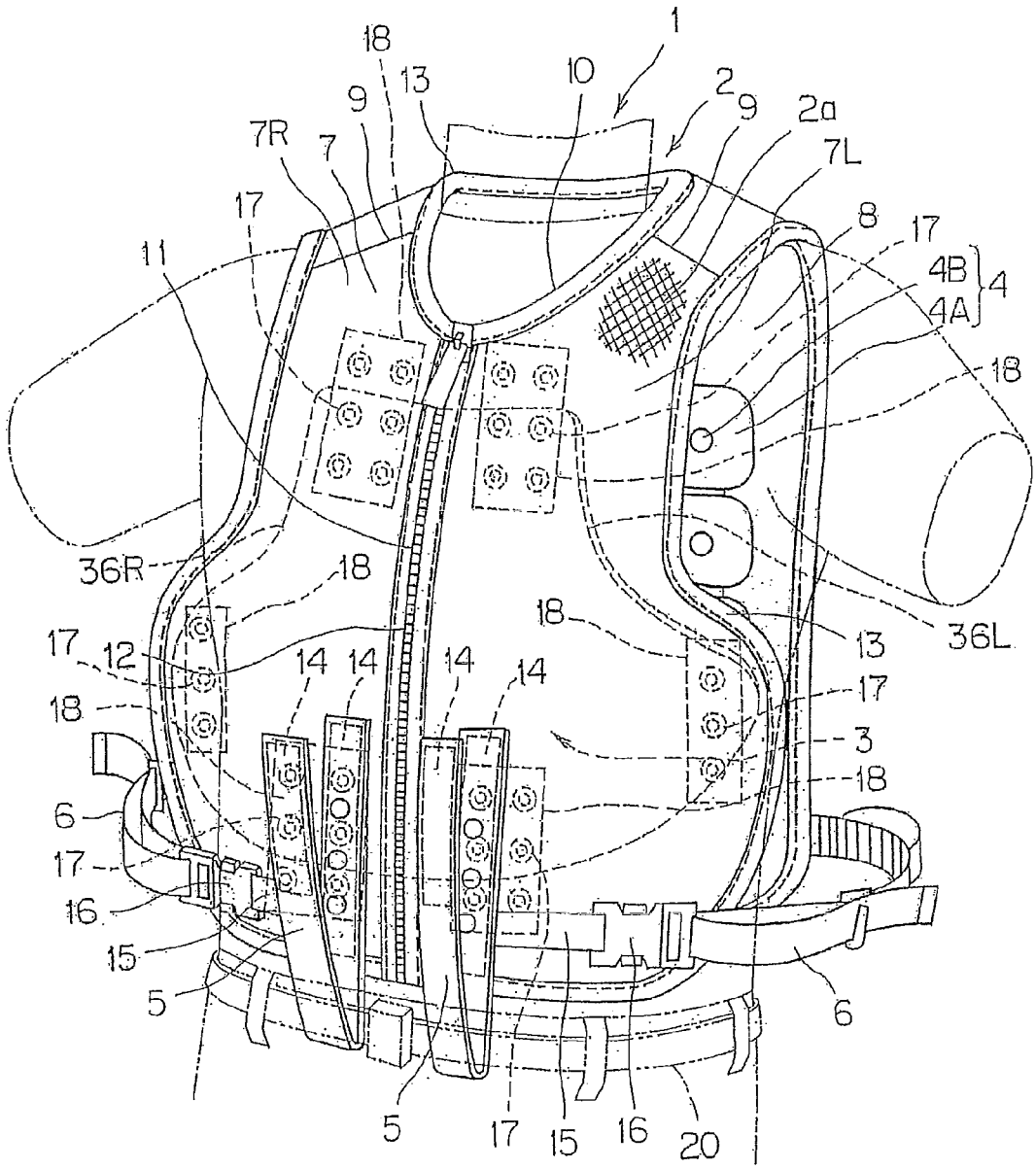
FIG. 1 is a perspective view showing a protective garment of a first embodiment of the present invention when worn.

FIG. 1 is a perspective view showing a protective body garment (referred to in the following simply as a "protective garment") of the first embodiment of the present invention when worn. A protective garment 1 can be used to protect the upper body of the wearer and in this embodiment is worn on the upper body of a motorcyclist. The protective garment 1 has a waistcoat type garment 2. A chest protector 3 that covers the front of the wearer, a back protector 4 that covers the back of the wearer, belt holders 5 wrapped around a belt 20 of the wearer, and adjustment belts 6 wrapped around the waist of the wearer are provided at the waistcoat type garment 2.

The waistcoat type garment 2 has a waistcoat type construction where a front portion 7 coming into contact with the chest of the wearer and a rear portion 8 coming into contact with the back of the wearer are connected by connecting portions 9 in the vicinity of the shoulders of the wearer. A collar 10 the neck of the wearer passes through is provided in the middle of the connecting portions 9. An opening and closing section 11 that continues from the lower part of the collar 10 to the lower part of the front portion 7 and separates the front portion 7 to the left and right is formed at the center of the front portion 7. The front portion 7 is then separated into a left portion 7L and a right portion 7R. A slide fastener that connects the left portion 7L and the right portion 7R so as to be freely openable and closeable is provided at the opening and closing section 11. The waistcoat type garment 2 is made from a mesh-like cloth 2*a* having ventilation. A trim 13 spanning the entire periphery is provided at the edge of the front portion 7, the rear portion 8, the opening and closing section 11 and the collar 10. The trim 13 is folded in two so as to make contact continuously with the front and back of the cloth 2*a* and is sewed at an edge portion.

The belt holders 5 are formed in a belt-shape and are provided at the left portion 7L and the right portion 7R, respectively. Ends of the belt holders 5 are provided at lower parts of the left portion 7L and the right portion 7R, and the remaining ends are freely movable free ends. Surface fasteners 14 having a fastening function are provided at the front side of the belt holders 5. The wearer wraps the surface fasteners 14 around the belt 20 of the wearer and can detachably connect the other ends of the surface fasteners 14 to arbitrary positions in the longitudinal direction of the belt holders 5. The waistcoat type garment 2 is constructed so that upper and lower positions can be freely adjusted by the wearer.

The adjustment belts 6 are provided at both ends in a widthwise direction at a lower part of the rear portion 8. Corresponding stopping belts 15 capable of connecting with the adjustment belts 6 are then provided at both ends in the widthwise direction of the front portion 7. Buckles 16 that couple with the stopping belts 15 are provided at the ends of the adjustment belts 6. The positions of the buckles 16 in the longitudinal direction of the adjustment belts 6 can be freely adjusted. The wearer can therefore adjust the garment 2 around their waist while the garment 2 is worn.

The back protector 4 is divided into a plurality of plates 4A extending in a widthwise direction of the rear portion 8. Each of the plates 4A is fitted between the wearer and the rear portion 8 at the rear portion 8, i.e. via a hook 4B at the back surface of the rear portion 8.

Figure 2:
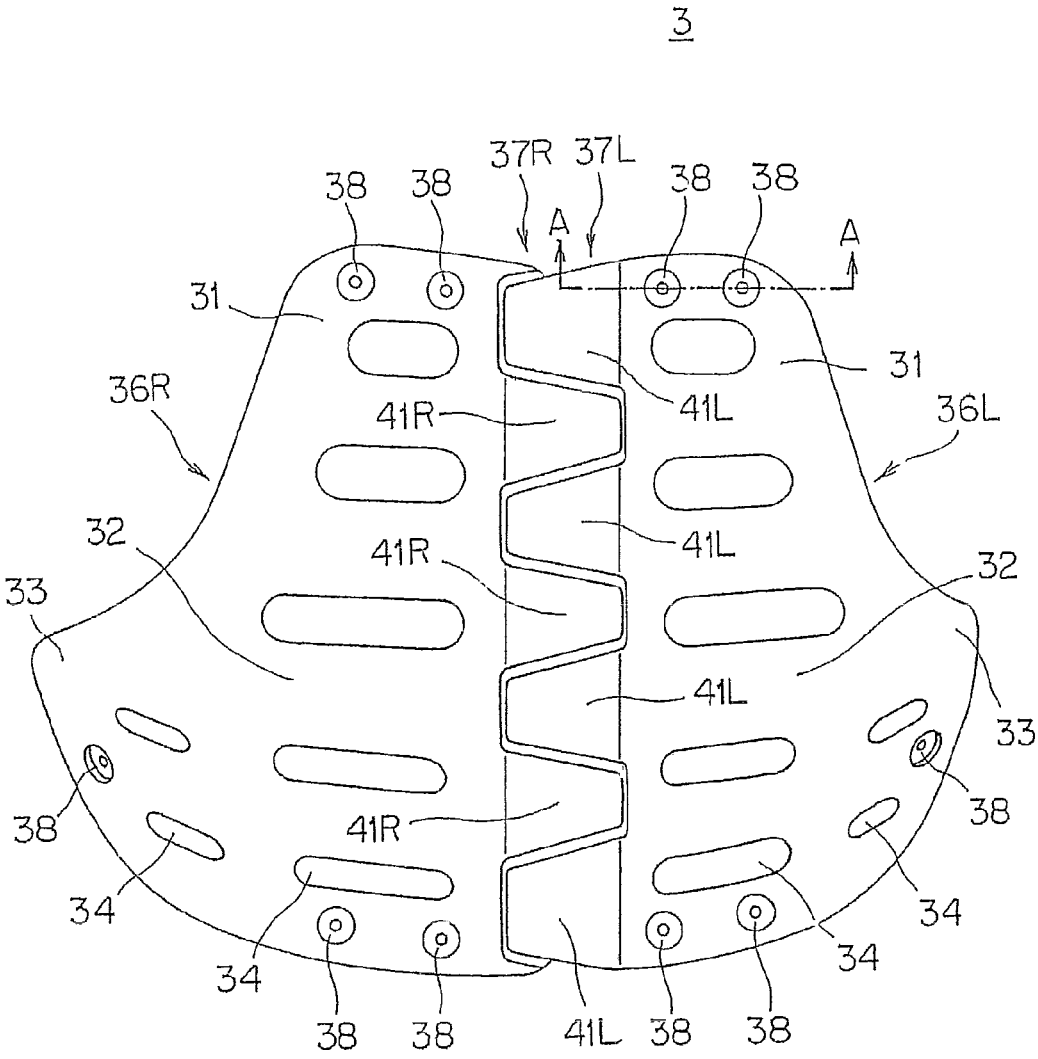
FIG. 2 is a perspective view of a chest protector when viewed from the front.
Figure 3:
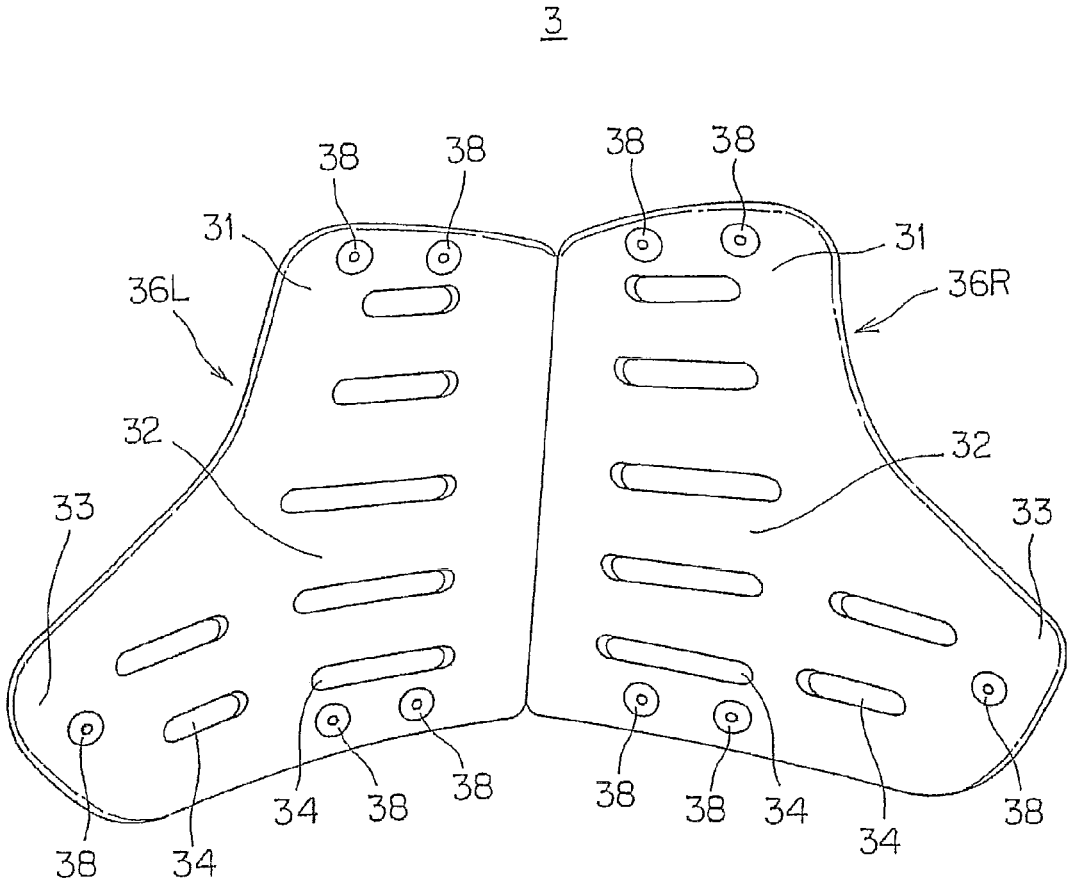
FIG. 3 is a perspective view of the chest protector when viewed from the rear.

The chest protector 3 is fitted between the wearer and the front portion 7 at the front portion 7, i.e. to the back surface of the front portion 7. FIG. 2 is a perspective view of the chest protector 3 viewed from the front. FIG. 3 is a perspective view of the chest protector 3 viewed from the rear. The chest protector 3 is a protective member having a shape that covers the chest and the upper abdominal region of the wearer. The chest is covered by an upper portion 31 of the chest protector 3 and the upper abdominal region is covered by a lower portion 32 of the chest protector 3. As shown in FIGS. 1 to 3, flanks 33 that are wider than the upper portion 31 so as to be enabled to be taken around as far as the flank of the wearer are formed at the lower portion 32 of the chest protector 3 and are capable of covering as far as the flanks of the wearer when worn. The chest protector 3 is formed so as to curve so that the front surface of the chest protector 3 becomes a convex curved surface and is therefore formed in a shape that can easily fit on the chest and the upper abdominal region of the wearer.

As shown in FIGS. 2 and 3, the chest protector 3 is provided with a left shell (left member) 36L and a right shell (right member) 36R that are provided to the left and right centrally in a widthwise direction. The left and right shells 36L and 36R are both made from a hard synthetic resin of, for example, polypropylene resin taken as a molding material molded into a hollow shape using blow molding techniques, etc. A left engaging portion 37L and a right engaging portion 37R are provided at a mutually coupling portion. The left and right shells 36L and 36R are capable of being coupled and separated. Separation positions for the left and right shells 36L and 36R overlap at the opening and closing section 11 of the garment 2 and separate at substantially the center from left to right of the chest of the wearer.

A plurality of female hooks 38 are fixed to the upper end, lower end, and flanks 33 of each of the left and right shells 36L and 36R. Each of the female hooks 38 then engage with male hooks 17 (FIG. 1) of the garment 2. The female hooks 38 are provided at positions corresponding to the male hooks 17 and are formed in rows of two at the upper ends and lower ends of the left and right shells 36L and 36R, with one each also being formed at the flanks 33. The left and right shells 36L and 36R are fitted to the back surface of the garment 2 as a result of engagement of the male hooks 17 and the female hooks 38. The left shell 36L is fitted to the left portion 7L and the right shell 36R is fitted to the right portion 7R. The wearer can then select positions for fitting the left and right shells 36L and 36R from each of the positions of the three male hooks 17 lined up vertically and can therefore adjust the fitting position in the vertical direction of the chest protector 3. The male hooks 17 can be engaged simply by pushing onto the female hooks 38 and can be released simply by pulling the male hooks 17 from the female hooks 38 while releasing this engagement. The left and right shells 36L and 36R can therefore be easily attached to and detached from the garment 2. The male hooks 17 are fitted via base cloth 18 sewn to the mesh-like cloth 2*a*. Thus, the fitting strength is ensured.

A plurality of long ventilation holes 34 extending in a widthwise direction of the chest protector 3 are formed vertically in a straight line as a number of rows from the upper portion 31 to the lower portion 32 at the chest protector 3 so as to enable cooling. The ventilation holes are also formed at the flanks 33. The ventilation holes 34 are shaped like a slot when the chest protector 3 is viewed from the front, but when viewed from the back, it can be seen that the end portions of the ventilation holes 34 on the center side are slanted from the front of the chest protector 3 towards the back so as to make the holes gradually wider in a longitudinal direction. It is therefore possible to ensure that cooling spans a broad range.

Figure 4:
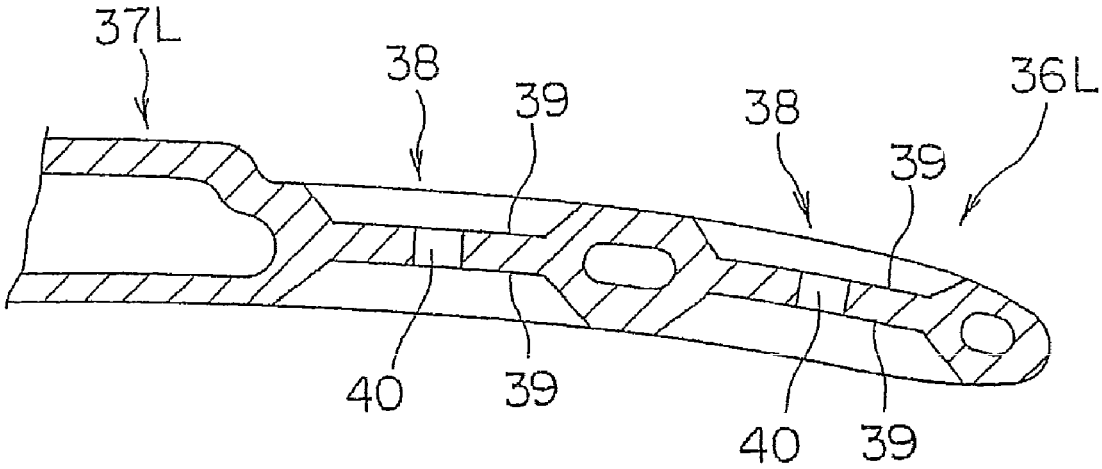
FIG. 4 is a cross-sectional view of the left shell of FIG. 2 cut along line A-A.

FIG. 4 is a cross-sectional view of the left shell 36L in FIG. 2 cut along line A-A. The female hooks 38 have bearing surfaces 39 formed so as to be markedly hollowed from both the front and the back sides of the chest protector 3. The holes 40 that the male hooks 17 engage with are formed at the bearing surfaces 39. Hollows are also formed in the vicinity of the left engaging portion 37L and the female hooks 38. The chest protector 3 has hollows formed all over in this manner. It is therefore possible for the chest protector 3 to maintain appropriate rigidity with respect to the force from outside while suppressing increases in weight. The chest protector 3 is also capable of moderate deformation and can therefore deal with the force from outside effectively.

Figure 5:
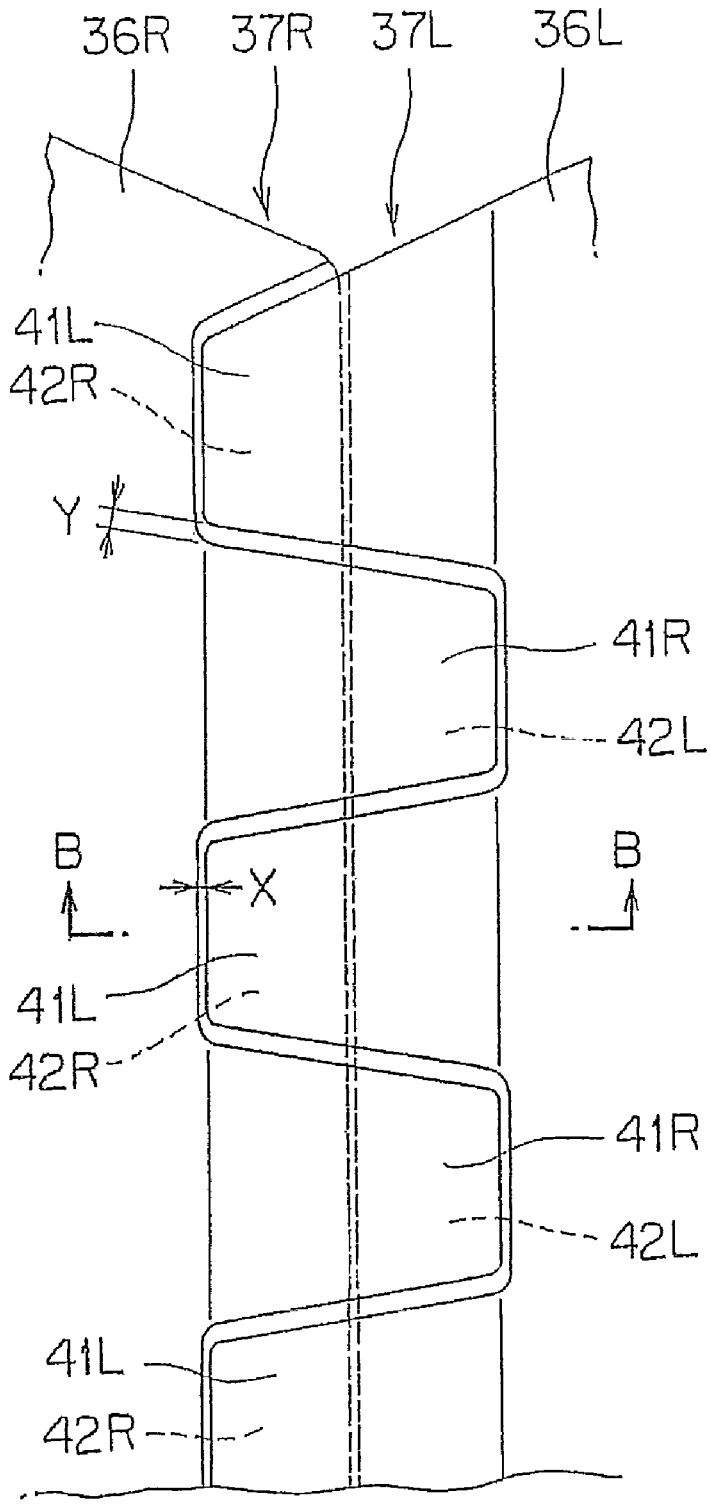
FIG. 5 is a front view showing the left and right engaging portions when engaged.

As shown in FIG. 5, the left and right engaging portions 37L and 37R include projecting portions 41L and 41R alternately lined up in a vertical direction, and receptors (stopping portions) 42L, 42R that receive the projecting portions on the opposing sides. The projecting portions 41L and 41R are arranged so as to alternately engage each other in a state where the left and right shells 36L and 36R engage with each other. The front sides of the left and right engaging portions 37L and 37R are embedded in the projecting portions 41L and 41R with substantially no gap. An amount of play indicated by a distance X is provided between the tips of the projecting portions 41L and 41R and the ends of the receptors 42. Play indicated by a distance Y is also provided between neighboring projecting portions 41L and 41R. The left and right shells 36L and 36R can therefore be easily fitted. The distance Y can be set to be large at twice the distance X.

Figure 6:
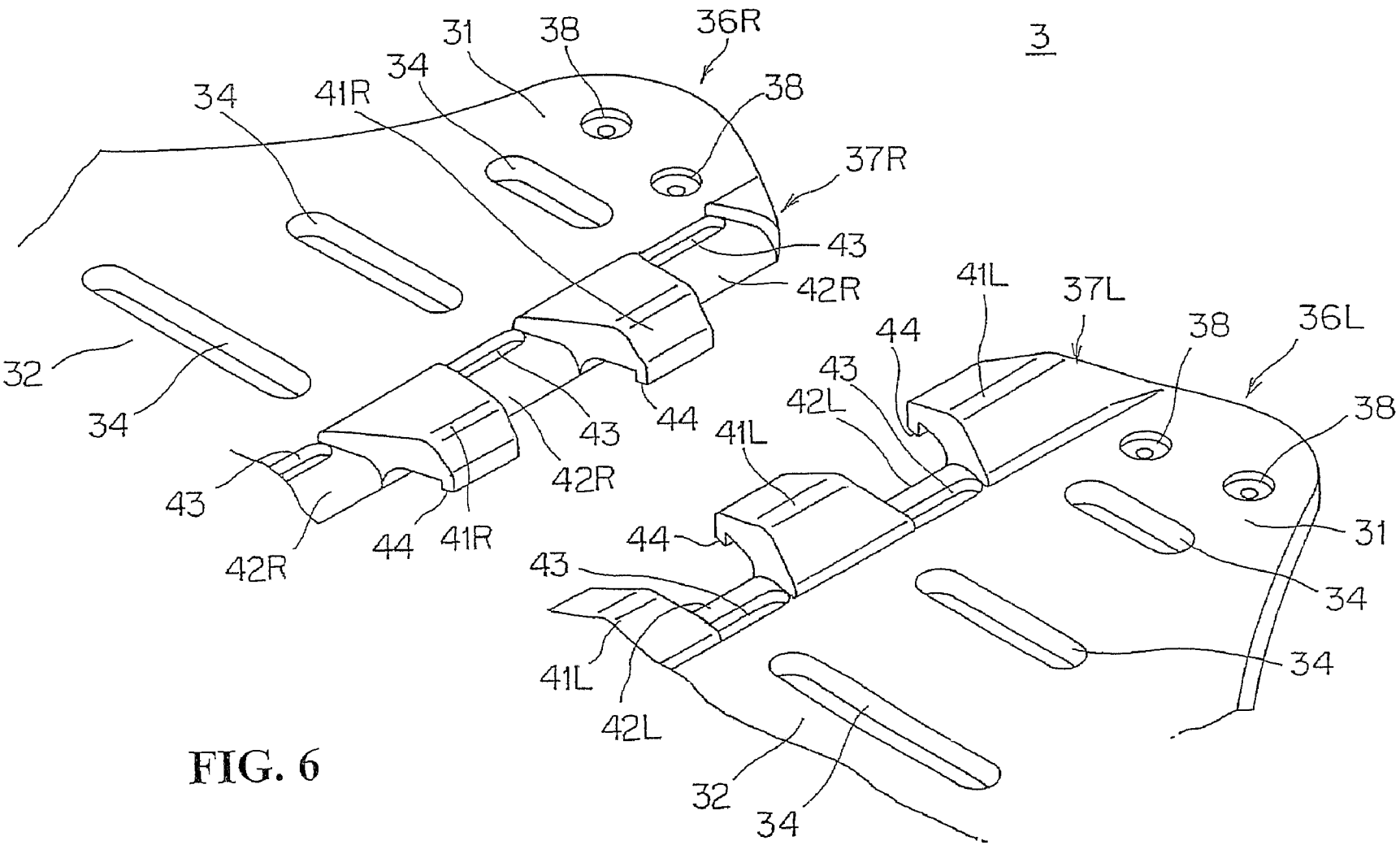
FIG. 6 is a perspective view showing the left and right shells when separated.

As shown in FIG. 6, the left and right engaging portions 37L and 37R have projecting portions 41L and 41R formed along positions dividing the left and right shells 36L and 36R so as to extend towards the front surfaces of the opposing sides. More specifically, the projecting portions 41L of the left shell 36L extend to the receptor 42R formed on an engaging surface of the right engaging portion 37R. On the other hand, the projecting portion 41R of the right shell 36R extends to the receptors 42L formed on the engaging surface of the left engaging portion 37L. The projecting portions 41L and 41R extend towards the opposing projecting portions and are formed so as to taper off so as to appear trapezoidal when viewed from the front. The receptors 42L and 42R are then formed in a shape capable of engaging the projecting portions 41L and 41R corresponding to this tapered shape.

The projecting portions 41L and 41R project markedly from the upper surface of the left and right shells 36L and 36R. Lugs 44 are formed at the tips of the projecting portions 41L and 41R and extend towards the opposing side. The lugs 44 freely engage with recesses 43 formed at the rear of each of the engaging services at the receptors 42L and 42R. The recesses 43 are formed as long holes extending vertically in the vicinity of the base sections of the projecting portions 41L and 41R at the plurality of receptors 42L and 42R lined up in the vertical direction.

Figure 7:
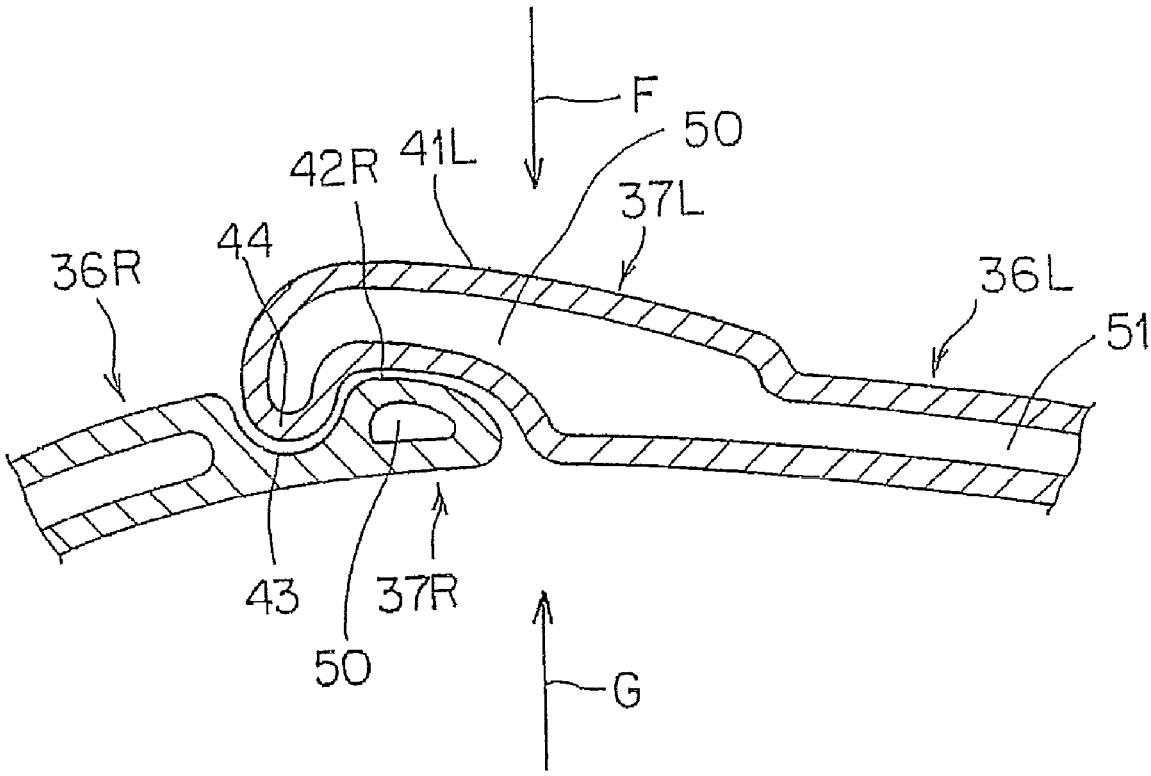
FIG. 7 is a cross-sectional view of the left and right shells of FIG. 5 cut along line B-B.

FIG. 7 is a cross-sectional view taken along line B-B of the left and right shells 36L and 36R of FIG. 5. In the state when the left and right engaging portions 37L and 37R are fitted, projecting portions 41L and 41R of the left and right shells 36L and 36R fit with corresponding receptors 42L and 42R and each lug 44 engages with each of the recesses 43. It is therefore possible to resist the force separating the left and right shells 36L and 36R in a lateral direction because the lugs 44 engage with the recesses 43 and it is possible for an unintentional separation of the chest protector 3 to be prevented. The tip of the receptor 42R is formed in the shape of a tapered curved surface. The inner surfaces of the projecting portions 41L that this curved surface fits with are formed as curved surfaces matching with the curved surface. The projecting portions 41L and the receptors 42R have hollow portions 50. The hollow portions 50 of the projecting portions 41L communicate with hollow portions 51 of the left shell 36L and extend as far as the lugs 44. It is therefore possible to ensure that the projecting portions 41L are appropriately rigid and lightweight. FIG. 7 shows a cross-section where a projecting portion 41L is fitted at the receptor 42R. The cross-section that the projecting portion 41R fits into at the receptors 42L is constructed so as to be symmetrical with a cross-section along a line B-B in FIG. 5 taking a central position in a widthwise direction of the chest protector 3 as a reference.

Next, an explanation is given of a method for wearing the chest protector 3. As an example of a wearing method, the wearer first fits the left and right shells 36L and 36R in a separated state to the garment 2. A slide fastener 12 is then opened and the garment 2 can be worn by the wearer passing their arms between the front portion 7 and the rear portion 8. It is therefore possible to appropriately wear the garment 2 with the chest protector 3 fitted by then fitting the left shell 36L and the right shell 36R, closing the slide fastener 12, and fixing the belt holders 5 and the adjustment belts 6.

In the protective garment 1 constructed so as to cover a broad range of an upper abdominal region including the chest and the flanks of the wearer using the single piece chest protector 3, it is possible to separate the chest protector 3 to the left and right. This means that it is possible to open the opening and closing section 11 so as to wear the protective garment and it is therefore possible to easily wear the protective garment 1. This also means that even the chest protector 3 of a shape curved so as to cover up to the flanks can be easily worn. When the wearer wishes to remove the chest protector 3, after opening the slide fastener 12, the chest protector 3 is separated to the left and right. The chest protector 3 can therefore be easily removed from the opening and closing section 11 without taking off the protective garment 1. In a further method of wearing the garment 2, it is possible for the wearer to wear the garment 2 with the chest protector 3 fitted and the slide fastener 12 closed. Next, the wearer can appropriately wear the garment 2 with the chest protector 3 fitted by fixing using the belt holders 5 and the adjustment belts 6.

When the wearer of the protective garment 1 wishes, for example, to cool down by unbuttoning the front portion of the protective garment 1, it is possible to easily open the front section by opening the slide fastener 12 and separating the chest protector 3 into the left shell 36L and the right shell 36R. Thus, cooling off is therefore straightforward.

An explanation is now given of the function of the chest protector 3 when a force acts on the chest protector 3 from the outside. When a force acts from the front of the chest protector 3 as shown by arrow F in FIG. 7 when the chest protector 3 is worn by the wearer via the garment 2, the force acts at the chest protector 3 so as to bend the left and right ends of the chest protector 3 in a forward direction centered about the left and right engaging portions 37L and 37R. In this event, the projecting portions 41L come into contact with the receptors 42R, the projecting portions 41R came into contact with the receptors 42L, and the left and right shells 36L and 36R mesh so as to mutually support each other. The chest protector 3 can therefore oppose force from the front. Namely, the receptors 42L and 42R receiving the projecting portions 41L and 41R function as stopping portions that oppose pressing from the front. As a result, the chest protector 3 can be separated to the left and right at the left and right engaging portions 37L and 37R and can implement a structure where high protection performance can be acquired that is capable of opposing a pressing force from the front. The chest protector 3 can be separated to the left and right and can be connected continuously without pause at the left and right engaging portions 37L and 37R. A broad range can therefore be protected and protection performance is therefore high.

When a force acts from the rear of the chest protector 3 as shown by the arrow G in FIG. 7, a force acts at the chest protector 3 so as to bend the left and right ends of the chest protector 3 to the rear centered about the left and right engaging portions 37L and 37R. In this event, the projecting portions 41L and 41R are not supported by the opposing receptors 42L and 42R but rather are distanced from the receptors 42L and 42R. As a result, fitting of the left and right shells 36L and 36R is released and the chest protector 3 can be separated to the left and right. When the wearer wishes to separate the chest protector 3, it is sufficient to bend the chest protector 3 in a rearward direction.

According to an embodiment of the present invention, it is possible to cover a broad range of the chest and the upper abdominal region with the single piece chest protector 3 while using the chest protector 3 as a protective member. When it is then wished to separate the chest protector 3, separation is possible by simply releasing fitting of the left shell 36L and the right shell 36R. As a result, a broad range of the chest and the upper abdominal region of the wearer is covered by the chest protector 3 and a high degree of protection performance can be ensured. When it is wished to undo the front portion, the chest protector 3 is separated and the front portion of the garment 2 and the chest protector 3 can be easily undone for cooling purposes.

It is also possible for a pressing force from the front of the chest protector 3 to be opposed by the receptors (stopping portions) 42L and 42R that each of the left and right shells 36L and 36R are provided with. It is therefore possible to deal with the pressing force from the front even in cases where a structure that can be separated is adopted for the chest protector 3 and high protection performance can therefore be obtained. Further, the left and right shells 36L and 36R engage in such a manner that a plurality of fellow projecting portions 41L and 41R are alternately lined up. Stress can therefore be distributed at the plurality of projecting portions 41L and 41R, the stress that the left and right engaging portions 37L and 37R are subjected to can be made uniform, and the rigidity and strength required with respect to pressing force from the front can be ensured.

With regards to a pressing force from the front of the chest protector 3, projecting portions 41L and 41R extending at the receptors 42L and 42R on the opposing side are mutually supported by the receptors 42L and 42R. The pressing force from the front can therefore be dealt with. On the other hand, the projecting portions 41L and 41R are not mutually supported by the receptors 42L and 42R with respect to a pressing force from the back of the chest protector 3. Fitting of the chest protector 3 is therefore released as a result of pressing force from the back and the front portion of the garment 2 and chest protector 3 can easily be undone to allow for a cooling off. It is also possible to oppose the force separating the chest protector 3 in a lateral direction because the lugs 44 formed at the projecting portions 41L and 41R fit with the recesses 43 formed at the receptors 42L and 42R on opposing sides. As a result, unintentional releasing of the engagement of the left and right shells 36L and 36R and separation of the chest protector 3 to the left and right can be prevented.

The embodiment described above depicts one mode of applying the present invention but the present invention is by no means limited to the above embodiment. For example, in the first embodiment an explanation is given taking the garment 2 to be a waistcoat-type garment. The present invention is however by no means limited in this respect, and the garment can also be, for example, a so-called jacket type with long sleeves or short sleeves. In this event, it is possible for the garment with the chest protector 3 fitted to easily be put on for a jacket-type garment where putting on with the opening and closing portion in a closed state is difficult by opening the opening and closing portion, separating the chest protector 3, and passing the arms through the left and right sleeves. In the first embodiment, an explanation is given where the chest protector 3 covers an upper abdominal region including the chest and the flanks of the wearer. However the present invention is by no means limited in this respect, and it is also possible, for example, for the size of the chest protector 3 in the vertical direction to be reduced so that only the chest is covered, or alternatively for the size in the vertical direction of the chest protector 3 to be enlarged so as to further broaden the protective range.

Further, an explanation is given where the receptors 42L and 42R function as stopping portions that mutually oppose a pressing force from the front. However, this is by no means limiting, and the stopping portions can be any item that opposes pressing force mutually from the front. For example, a lug extending to the side of the right engaging portion 37R can be provided at the left engaging portion 37L. A sheath-shaped engaging hole that the lug engages with can then be provided at the right engaging portion 37R with the left and right engaging portions 37L and 37R then engaging. According to this structure, the engaging hole and the lugs therefore mutually support each other and function as stopping portions with respect to the pressing force from the front. It is therefore possible to oppose the pressing force from the front. An explanation is given where the chest protector 3 separates into the left and right shells 36L and 36R but the present invention is by no means limited in this respect. For example, the chest protector 3 can also be provided with a third central member between the left and right shells 36L and 36R so as to separate into three. One side of the central member and the left shell 36L, and the other side of the central member and the right shell 36R can then engage. In this event, it is possible for the central member to remain engaged as part of one of the left and right shells 36L and 36R while separating the left and right shells 36L and 36R. It is of course possible to arbitrarily change other details of the configuration for the protective garment 1.

In a second embodiment, portions that are configured the same way as for the first embodiment are given the same numerals and are not described. In the second embodiment, a chest protector 130 is fitted to the garment 2 in place of the chest protector 3 of the first embodiment. The chest protector 130 is provided with left and right shells 136L and 136R. Structures for left and right engaging portions 137L and 137R of the left and right shells 136L and 136R for the chest protector 130 described in the second embodiment are different to those of the left and right engaging portions 37L and 37R of the first embodiment.

Figure 8:
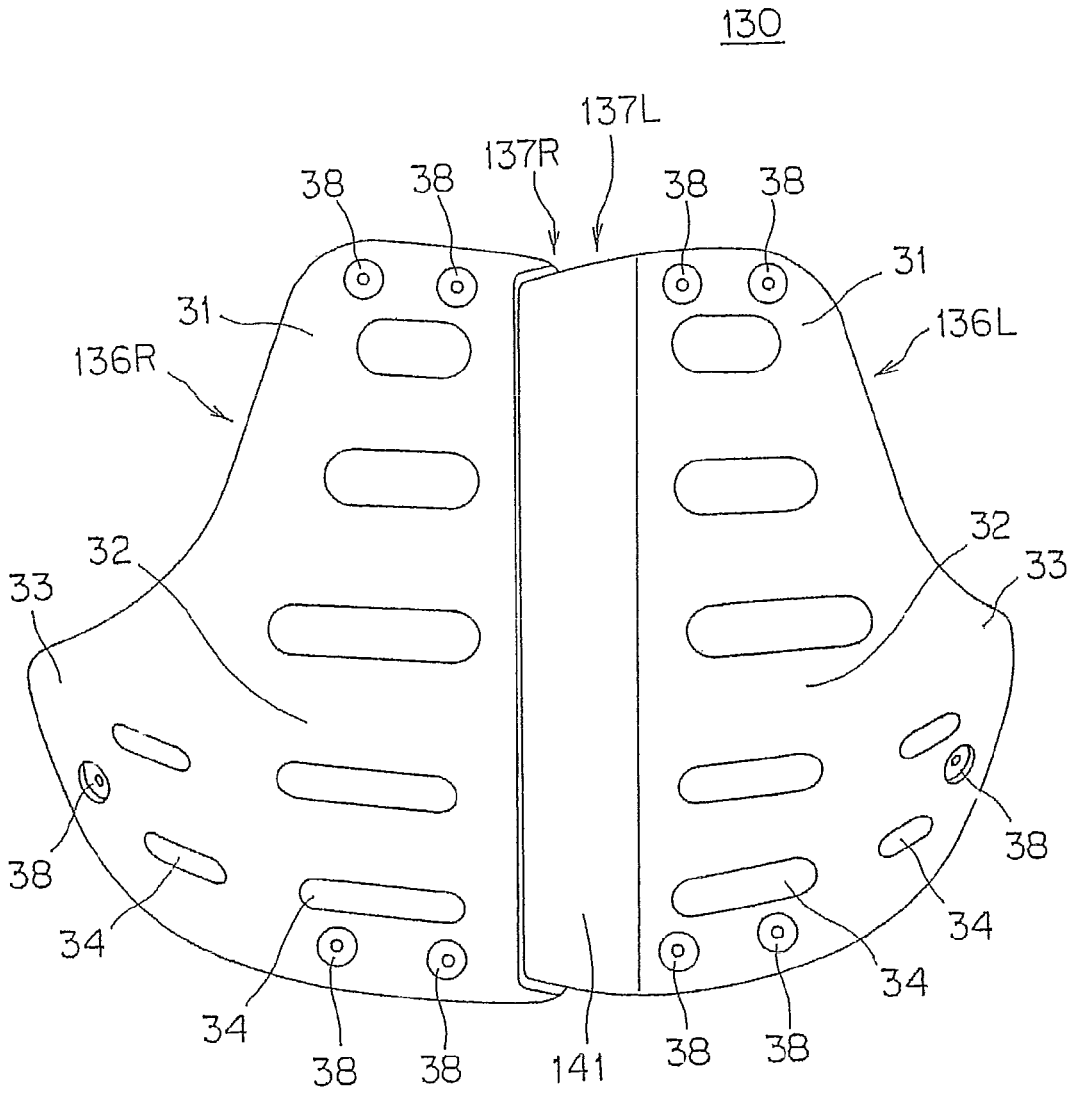
FIG. 8 is a perspective view of the chest protector of the second embodiment as viewed from the front.
Figure 9:
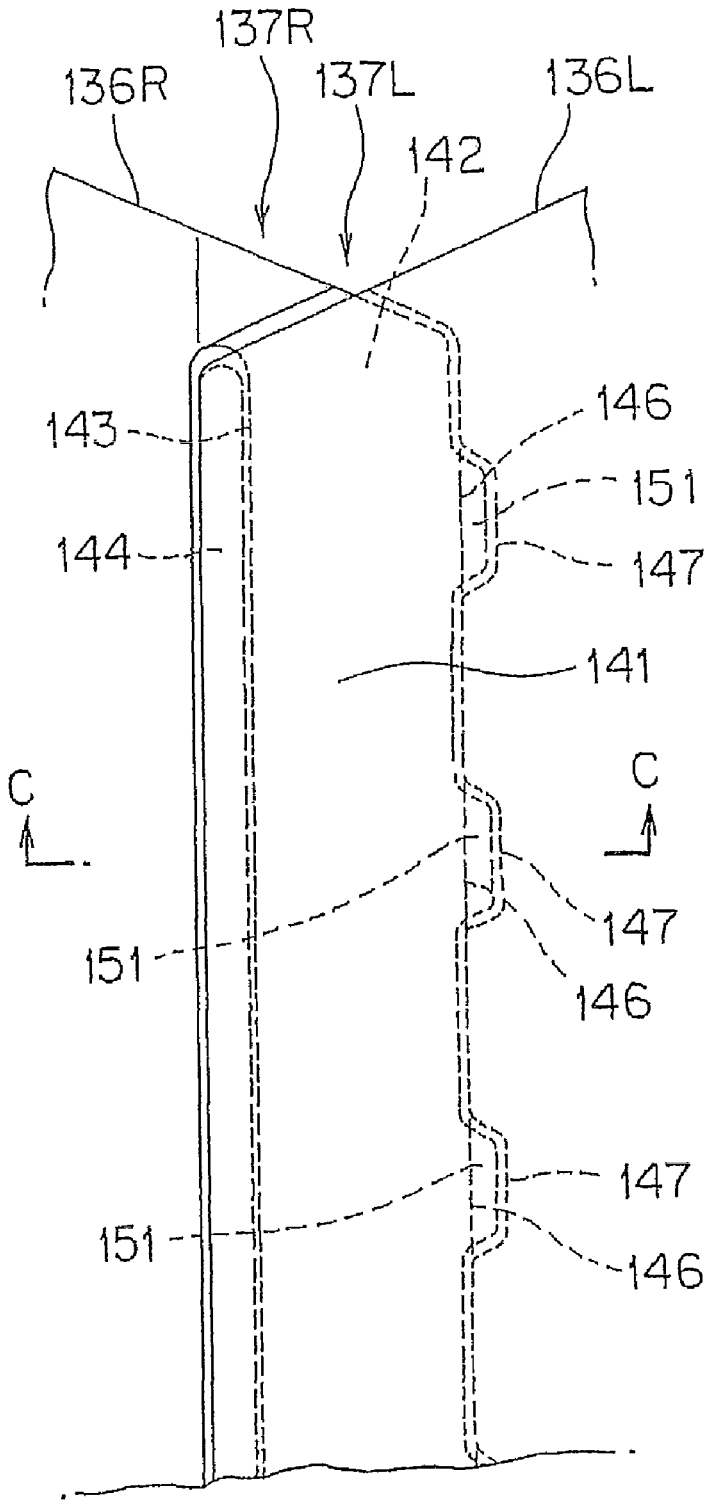
FIG. 9 is a front view showing the left and right engaging portions when engaged.

FIG. 8 is a perspective view of the chest protector 130 viewed from the front. FIG. 9 is a front view showing the left and right engaging portions 137L and 137R in an engaged state. In a direction from front to rear of the chest protector 130, the left and right shells 136L and 136R engage so that an outwardly projecting portion 141 and a plurality of inwardly projecting portions 151 overlap from front to rear. Namely, the left and right engaging portions 137L and 137R are equipped with the outwardly projecting portion 141 and the inwardly projecting portions 151 that overlap each other from front to rear. The outwardly projecting portion 141 is provided at the left engaging portion 137L and the inwardly projecting portions 151 are provided at the left engaging portion 137R.

Figure 10:
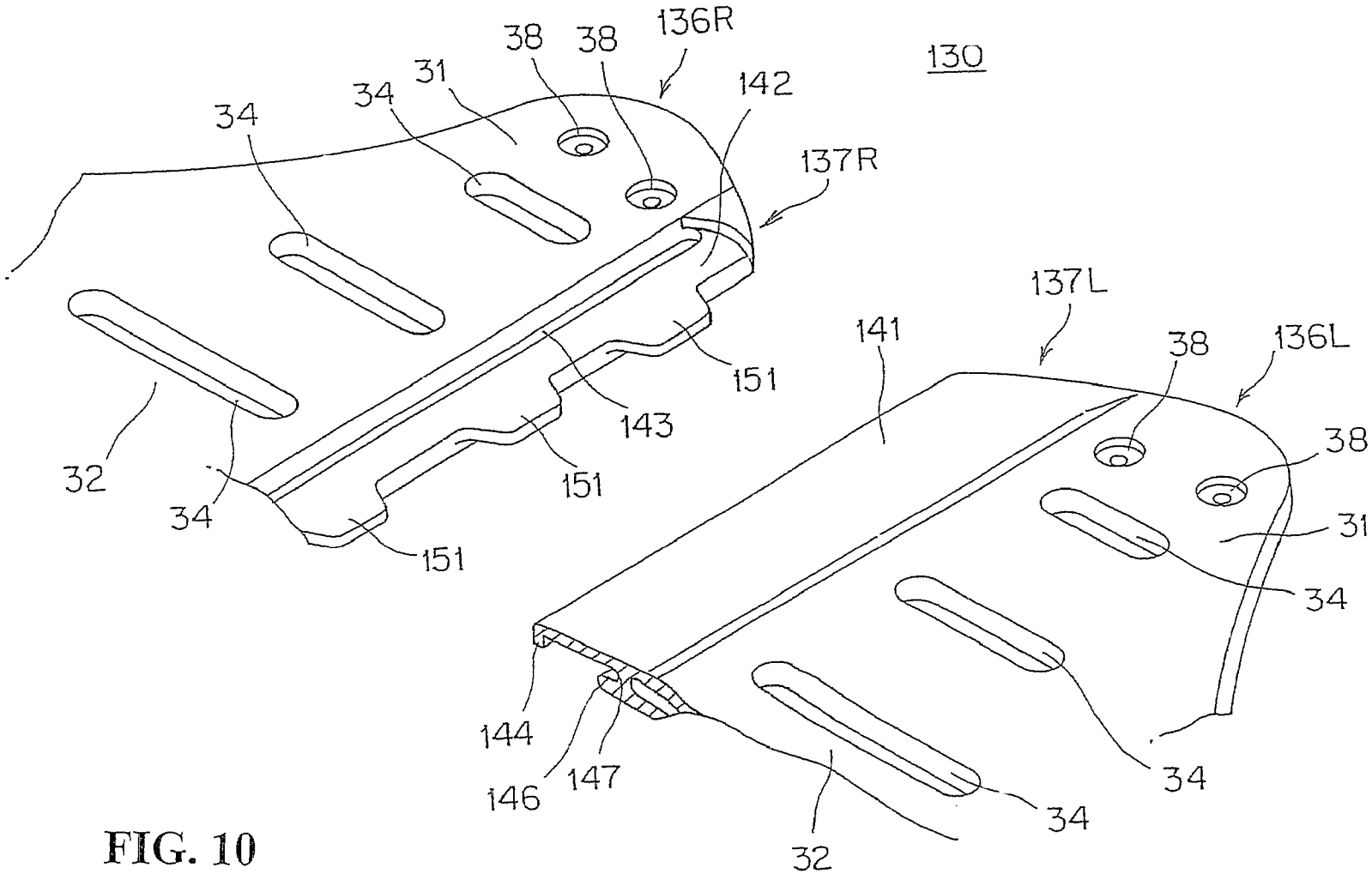
FIG. 10 is a perspective view showing the left and right shells when separated.

FIG. 10 is a perspective view showing the situation where the left and right shells 136L and 136R are separated. The chest protector 130 includes the left shell 136L and the right shell 136R separated to the left and right centrally in a widthwise direction. The left and right shells 136L and 136R are configured to be connectable and separable by mutually engaging the left engaging portion 137L and the right engaging portion 137R respectively of the left and right shells 136L and 136R. The left and right engaging portions 137L and 137R are formed along a position of separation of the left and right shells 136L and 136R.

The outwardly projecting portion 141 formed at the left engaging portion 137L extends to a receptor (stopping portion) 142 formed at the front surface of the right shell 136R on the opposing side. The outwardly projecting portion 141 is formed along the whole of the left engaging portion 137L extending in a vertical direction. The inwardly projecting portions 151 formed at the right engaging portion 137R extend to the side of the left shell 136L on the opposing side. The plurality of inwardly projecting portions 151 are arranged at substantially equal intervals at the right engaging portion 137R extending in the vertical direction.

Figure 11:
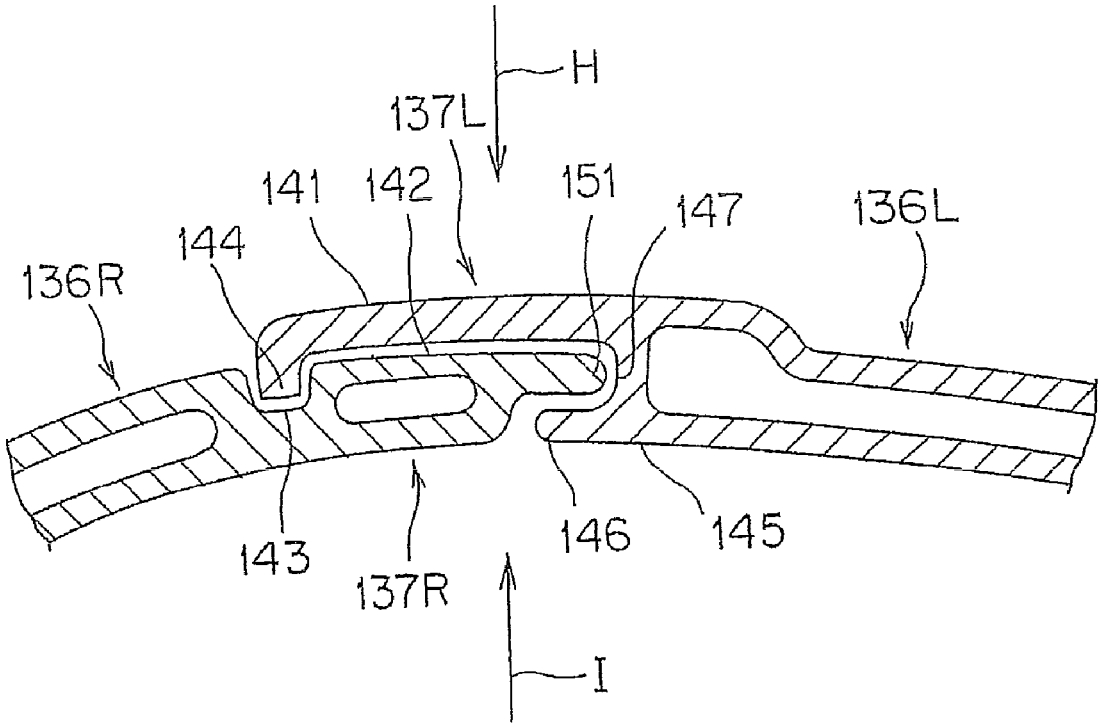
FIG. 11 is a cross-sectional view of the left and right shells of FIG. 9 cut along line C-C.

FIG. 11 is a cross-sectional view of the left and right shells 136L and 136R in FIG. 9 taken along a line C-C. As shown in FIGS. 9 and 11, the outwardly projecting portion 141 fits into the receptor 142 from the front side of the chest protector 130 and the inwardly projecting portions 151 fit into extending portions (stopping portions) 146 extending at the sides of the inwardly projecting portions 151 from the rear surface side of the chest protector 130. The extending portions 146 extend towards the inside of the inwardly projecting portions 151 from a base 145 positioned at the bases of the outwardly projecting portion 141. The extending portions 146 shown in FIG. 9 are provided at substantially equal intervals corresponding to the inwardly projecting portions 151, the plurality of which are also arranged at substantially equal intervals. Namely, the extending portions 146 constitute a depression 147 that the inwardly projecting portions 151 insert into.

As shown in FIG. 11, the outwardly projecting portion 141 project markedly from the upper surface of the left shell 136L. A lug 144 engaging with a recess 143 formed at the front surface of the receptor 142 is formed at the tip of the outwardly projecting portion 141. The recess 143 and the lug 144 are formed continuously along a longitudinal direction of the left and right engaging portions 137L and 137R. It is therefore possible for there to be resistance to the force attempting to separate the left and right shells 136L and 136R to the left and right because the lug 144 engages with the recess 143. It is therefore possible to prevent the chest protector 130 from becoming unintentionally separated.

An explanation is now given of the function of the chest protector 130 when an external force acts on the chest protector 130. When a force acts from the front of the chest protector 130 as shown by arrow H in FIG. 11, in a situation where the chest protector 130 is worn by the wearer via the garment 2, a force acts on the chest protector 130 centered on the left and right engaging portions 137L and 137R so as to attempt to bend the left and right ends of the chest protector 130 in a direction towards the front. In this event, the outwardly projecting portion 141 makes contact with the receptor 142, the inwardly projecting portions 151 make contact with the extending portions 146, and the left and right shells 136L and 136R mutually support each other. It is therefore possible for the chest protector 130 to oppose the force from the front. This is to say that the receptor 142 and the extending portions 146 mutually function as stopping portions opposing the pressing force from the front. As a result, the chest protector 130 can therefore be constructed so as to be capable of being separated to the left and right at the left and right engaging portions 137L and 137R implement protection performance where the ability to oppose the pressing force from the front is high. The chest protector 130 is therefore capable of protecting a broad range and providing high protection performance continuously at the left and right engaging portions 137L and 137R while being capable of being separated to the left and right.

When a force acts from the rear of the chest protector 130 as shown by arrow 1 in FIG. 11, the force acts at the chest protector 130 attempting to bend the left and right ends of the chest protector 130 in a rearward direction centered about the left and right engaging portions 137L and 137R. In this event, the outwardly projecting portion 141 is not supported at the receptor 142 but rather comes away from the receptor 142 and the inwardly projecting portions 151 come out of the extending portions 146. Engaging of the left and right shells 136L and 136R is therefore released and the chest protector 130 can be separated to the left and right. The chest protector 130 can therefore be bent in a rearward direction when the wearer wishes to separate the chest protector 130.

As described above, according to a second embodiment to which the present invention is applied, the outwardly projecting portion 141 supports the receptor 142 of the inwardly projecting portions 151 and the inwardly projecting portions 151 support the extending portions 146 of the outwardly projecting portion 141. The outwardly projecting portion 141 and the inwardly projecting portions 151 therefore mutually support each other. It is therefore possible to deal with pressing force from the front. On the other hand, with regards to pressing force from the back surface, the outwardly projecting portion 141 can be removed from the receptor 142 and the inwardly projecting portions 151 can be removed from the extending portions 146. Engagement can therefore be released by pressing the chest protector 130 from the back so that cool air can easily be taken in.

The first and second embodiment show modes of applying the present invention but the present invention is by no means limited to the above embodiments. For example, in the first embodiment, the projecting portions 41L and 41R and the receptors 42L and 42R are hollow but by adjusting the rigidity and the lightness of the weight being hollow is not essential, and the shape and location of the hollow can also be different. In the second embodiment, an explanation is given where the left engaging portion 137L has the outwardly projecting portion 141 and the right engaging portion 137R has the inwardly projecting portions 151. However, the present invention is by no means limited in this respect, and it is also possible for one of the left and right to have the outwardly projecting portion 141 and for the other to have the internal projecting portions 151. It is also possible for the left engaging portion 137L to have the inwardly projecting portions 151 and for the right engaging portion 137R to have outwardly projecting portion 141. It is also possible to have the engaging portion of the second embodiment and provide a plurality of projecting portions on the left and right as in the first embodiment. Engaging can then take place with the outwardly projecting portions and the inwardly projecting portions being alternately provided on the left and right. It is also possible for other details of the configuration to be arbitrarily changed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A chest protector detachably fitted to an interior surface of a body garment, the chest protector comprising:

left and right protective shell members;

said left and right protective shell members each have mutually engaging portions, with the engaging portions engaging with each other in a separable manner wherein the engaging portion of one of the left and right protective shell members is provided with a projecting portion, and the engaging portion of the other of the left and right protective shell members is provided with a stopping portion which opposes a pressing force from a front of the chest protector when the left and right protective shell members are engaged with each other, and when the left and right protective shell members are engaged with each other, the projecting portion covers the stopping portion so that substantially all of the stopping portion is not visible when the chest protector is viewed in front view.

2. The chest protector according to claim 1, wherein the projecting portion includes a plurality of projecting portions on each of the left and right engaging portions, with the left and right projecting portions being arranged alternately when engaged with each other.

3. The chest protector according to claim 2, wherein the left and right projecting portions extend forward on the front side of the opposing projecting portions, and each of the projecting portions has a lug for engaging with a recess formed on the front side of the opposing projecting portion.

4. The chest protector according to claim 1, wherein a rear side of each of the left and right protective shell members is provided with a single straight edge extending from top to bottom thereof, and when the left and right protective shell members are engaged together, the single straight edges of the protective shell members directly face and abut each other.

5. The chest protector according to claim 1, wherein either one of the left and right engaging portions, which overlap with each other from front to back, includes an outwardly projecting portion and the other engaging portion including an inwardly projecting portion, an extending portion extending to the inner side of the inwardly projecting portion being provided on a base portion of the outwardly projecting portion.

6. The chest protector according to claim 1, wherein the left and right shell protective members are separable when the pressing force is applied to a rear of the engaging portions of the chest protector, and since the stopping portion opposes the pressing force to the front, the left and right shell protective members are not separable when the pressing force is applied to the front of the engaging portions.

7. The chest protector according to claim 1, wherein the projecting portion provided on the engaging portion of the one of the left right protective shell member includes a plurality of projecting portions with lugs provided on each of the left and right protective shell members, and the projecting portions of the left protective shell member mating with corresponding recesses formed in the left protective shell member, and the projecting portions of the right protective shell member mating with corresponding recesses formed in the left protective shell member for securing the left protective shell member relative to the right protective shell member.

8. The chest protector according to claim 1, wherein at least one of the left protective shell member and the right protective shell member includes engaging portions formed as a single overlapping projecting member with a lug for mating with a corresponding single recess formed in at least one of the right protective shell member and the left protective shell member for securing the left protective shell member relative to the right protective shell member.

9. A chest protector detachably fitted to an interior surface of a body garment, the chest protector comprising:

a left securing member formed within the body garment in a left chest portion thereof;

a left protective shell member adapted to be secured to the left securing member;

a right securing member formed within the body garment in a right chest portion thereof;

a right protective shell member adapted to be secured to the right securing member;

a left protective shell member engaging portion;

a right protective shell member engaging portion;

wherein the left protective shell engaging portion and the right protective shell engaging portion selectively being engaged with each other to permit the left protective shell and the right protective shell to be secured in a selectively separable manner, wherein one of the left and right the engaging portions is provided with a projecting portion, and the other of the left and right the engaging portions is provided with a stopping portion opposes apressing force from a front of the chest protector when the left and right protective shell members are engaged with each other, and when the left and right protective shell members are engaged with each other, the projecting portion covers the stopping portion so that substantially all of the stopping portion is not visible when the chest protector is viewed in front view.

10. The chest protector according to claim 9, wherein the projecting portion includes a plurality of projecting portions on each of the left and right engaging portions, with the left and right projecting portions being arranged alternately when engaged with each other.

11. The chest protector according to claim 10, wherein the left and right projecting portions extend forward on the front side of the opposing projecting portions, and each of the projecting portions has a lug for engaging with a recess formed on the front side of the opposing projecting portion.

12. The chest protector according to claim 9, wherein the left and right projecting portions extend forward on the front side of the opposing projecting portions, and each of the projecting portions has a lug for engaging with a recess formed on the front side of the opposing projecting portion a rear side of each of the left and right protective shell members is provided with a single straight edge extending from top to bottom thereof, and when the left and right protective shell members are engaged together, the single straight edges of the protective shell members directly face and abut each other.

13. The chest protector according to claim 9, wherein either one of the left and right engaging portions, which overlap with each other from front to back, includes an outwardly projecting portion and the other engaging portion including an inwardly projecting portion, an extending portion extending to the inner side of the inwardly projecting portion being provided on a base portion of the outwardly projecting portion.

14. The chest protector according to claim 9, wherein the left and right shell protective members are separable when the pressing force is applied to a rear of the engaging portions of the chest protector, and since the stopping portion opposes the pressing force to the front, the left and right shell protective members are not separable when the pressing force is applied to the front of the engaging portions.

15. The chest protector according to claim 9, wherein the projecting portion provided on the engaging portion of the one of the left protective shell member and the right protective shell member includes a plurality of projecting portions with lugs provided on each of the left and right protective shell members, and the projecting portions of the left protective shell member mating with corresponding recesses formed in the left protective shell member, and the projecting portions of the right protective shell member mating with corresponding recesses formed in the left protective shell member for securing the left protective shell member relative to the right protective shell member.

16. The chest protector according to claim 9, wherein at least one of the left protective shell member and the right protective shell member includes engaging portions formed as a single overlapping projecting member with a lug for mating with a corresponding single recess formed in at least one of the right protective shell member and the left protective shell member for securing the left protective shell member relative to the right protective shell member.

* * * * *